United States Patent [19]

Murofushi et al.

[11] Patent Number: 4,837,100

[45] Date of Patent: Jun. 6, 1989

[54] ELECTROPHOTOGRAPHIC DEVELOPER CONTAINING POSITIVELY CHARGEABLE TONER

[75] Inventors: Toshiaki Murofushi; Yasuhiro Ohya; Hiroshi Nakazawa; Koichi Oyamada, all of Kanagawa, Japan

[73] Assignee: Fuji Xerox Co., Ltd., Tokyo, Japan

[21] Appl. No.: 102,456

[22] Filed: Sep. 29, 1987

[30] Foreign Application Priority Data

| | | | |
|---|---|---|---|
| Sep. 29, 1986 | [JP] | Japan | 61-228265 |
| Sep. 29, 1986 | [JP] | Japan | 61-228266 |
| Dec. 16, 1986 | [JP] | Japan | 61-297555 |

[51] Int. Cl.[4] ..... G03G 9/10

[52] U.S. Cl. ..... 430/106.6; 430/107

[58] Field of Search ..... 430/106.6, 108, 109, 430/110, 111, 107

[56] References Cited

U.S. PATENT DOCUMENTS

| | | | |
|---|---|---|---|
| 3,557,255 | 1/1971 | Sharkey | 260/879 |
| 3,585,257 | 6/1971 | Mueller et al. | 260/880 |
| 4,543,312 | 9/1985 | Murakawa et al. | 430/106.6 |
| 4,699,865 | 10/1987 | Mitsuhashi | 430/122 |

*Primary Examiner*—John L. Goodrow

*Attorney, Agent, or Firm*—Sughrue, Mion, Zinn, Macpeak & Seas

[57] ABSTRACT

A positively chargeable electrophotographic developer is disclosed, comprising a carrier, toner particles positively chargeable by friction with the carrier, fine particles of hydrophilic alumina, and fine particles of one of tin oxide, hydrophobic silica and titanium dioxide. The developer hardly undergoes toner cloud or toner dropping during development and suffers neither extreme deterioration in charging properties nor fog formation even when used for taking a large number of copies.

13 Claims, No Drawings

ELECTROPHOTOGRAPHIC DEVELOPER CONTAINING POSITIVELY CHARGEABLE TONER

FIELD OF THE INVENTION

This invention relates to a developer for developing an electrostatic image in electrophotography, electrostatic recording, and the like. More particularly, it relates to an electrophotographic developer which contains a uniformly and positively chargeable toner and produces a high quality image.

BACKGROUND OF THE INVENTION

In electrophotographic two-component system developers comprising a toner and a carrier, the electrical polarity of the toner, i.e., whether the toner should be charged positively or negatively, is selected according to the charging polarity of the photoreceptor to be used in the electrophotographic process. Such charging polarity of the toner depends chiefly on the kinds of substances constituting the toner and a carrier which triboelectrically charges the toner, and a substance located further from the positive side in the triboelectric series is negatively charged.

In recent years, organic electrophotographic photoreceptors having divided functions have been widely employed. Most of these organic electrophotographic photoreceptors are charged negatively in view of the mechanical nature thereof. Accordingly, positively chargeable toners have been demanded.

However, materials for positively chargeable toners are more limited than for negatively chargeable toners, making it difficult to design a toner composition for the negatively working photoreceptors.

Toners containing various additives have recently been proposed. Such additives include metallic or nonmetallic oxides, e.g., $SiO_2$, $Al_2O_3$, $SnO_2$, $TiO_2$, etc., and they are markedly effective to improve powder fluidity, charging properties, and cleanability of toner particles, as described in Japanese Patent Application (OPI) Nos. 112052/85, 238847/85 and 66951/83 (the term "OPI" herein used refers to a "published unexamined Japanese Patent Application").

These conventional additives, however, cause many problems when applied to positively chargeable toners. For instance, use of hydrophilic alumina provides a developer which neither causes fog nor suffers abrupt deterioration of charging properties even when employed repeatedly for producing a number of copies, but the images obtained through repeated use become inferior in quality. More specifically, when the developer is used for a long period of time, a so-called "toner cloud" phenomenon occurs in the neighborhood of a developing machine to induce contamination in the developing machine. As a result, the optical system is contaminated with the toner particles to cause shortage of light quantity, providing images of low contrast, i.e., low density. Further, the toner particles drop in masses to cause stains on transfer sheets. On the other hand, addition of fine powders of tin oxide, hydrophobic silica or titanium dioxide to a toner reduces a usable life of the developer. That is, the developer suffers extreme deterioration of charging properties and some toner particles contained therein are charged to the opposite polarity to cause fog when repeatedly used for obtaining a large number of copies even in a short period of time.

SUMMARY OF THE INVENTION

Accordingly, one object of this invention is to provide a positively chargeable electrophotographic developer which hardly causes a toner cloud phenomenon or a toner dropping phenomenon.

Another object of this invention is to provide a positively chargeable electrophotographic developer which is free from extreme deterioration in charging properties or fog generation even when used for obtaining a large number of copies.

A further object of this invention is to provide a positively chargeable electrophotographic developer which can form a high density image for an extended period of time.

As a result of extensive investigations, the inventors have found that a long-life electrophotographic developer capable of providing a high quality image can be obtained by using, as external additives for a toner, hydrophilic alumina fine powders in combination with fine particles of one of tin oxide, hydrophobic silica and titanium dioxide.

The present invention relates to an electrophotographic developer comprising a carrier, toner particles that are positively charged due to friction with the carrier, hydrophilic alumina fine particles, and fine particles of one of tin oxide, hydrophobic silica and titanium dioxide.

DETAILED DESCRIPTION OF THE INVENTION

The hydrophilic alumina which can be used in the present invention is alumina which has not been subjected to surface treatment (e.g., a treatment with an alkylsilane), such as Aluminum Oxide C (a product of Nippon Aerosil Co., Ltd.), etc. The hydrophilicity of the alumina is sufficient if the alumina can be dispersed in water.

The hydrophilic alumina particles suitably have an average particle size of from about 0.010 to 1.000 μm, and preferably from 0.010 to 0.030 μm. The hydrophilic alumina is generally used in an amount of from about 0.1 to 3.0% by weight, and preferably from 0.8 to 2.0% by weight, based on the weight of toner particles. If the amount of the hydrophilic alumina is less than 0.1% by weight, the toner cannot sufficiently be charged positively in some cases. If it exceeds 3.0% by weight, the toner tends to be deteriorated.

The tin oxide fine particles which can be used as the additive in combination with the hydrophilic alumina fine particles are those that have not been subjected to surface treatment and preferably have a specific resistivity of from $10^2$ to $10^9$ Ω·cm, and more preferably from $10^5$ to $10^8$ Ω·cm, as measured at 23° C. and 65 % RH by the use of a simplified specific resistivity meter using a Teflon cell of 5.5 cm in diameter and a press ram of 4.2 cm in diameter and 13.85 $cm^2$ in area under a pressure of 35.5 $Kg/cm^2$ applied to a hand press (100 $Kg/cm^2$ applied to a sample) at 500 V. The particle size of the tin oxide particles is generally not more than about 4 μm, and preferably not xore than 0.3 μm. The amount of the tin oxide fine particles to be added preferably ranges from 0.5 to 3.0 times, more preferably from 0.5 to 1 times, the weight of hydrophilic alumina fine particles. When it is less than 0.5 times or more than 3.0 times the weight of the hydrophilic alumina, image quality tends to degrade. That is, if it is less than 0.5 times, the toner cloud phenomenon readily takes place to reduce image density, and if it exceeds 3 times, fog is liable to occur.

The hydrophobic silica fine particles which can be used in combination with the hydrophilic alumina are obtained by subjecting silica particles to surface treatment such as treatment with an alkylsilane to render hydrophobic and include, for example, R-972 (a product of Nippon Aerosil Co., Ltd.). The surface treatment to render silica hydrophobic can be effected in a known manner. For example, 5 parts by weight of dichlorodimethylsilane and 100 parts by weight of silica particles are mixed at 150° C. for 30 minutes, and methanol produced is removed under reduced pressure, whereby hydrophobic silica fine particles are obtained. The hydrophobicity of the silica fine particles is sufficient if the silica fine particle cannot be dispersed in an aqueous solution containing less than 30% by weight of methanol. The hydrophobic silica fine particles have an average particle size generally ranging from about 0.005 to 1.000 μm, and preferably from 0.010 to 0.030 μm. The amount of the hydrophobic silica to be added is preferably from 1 to 30% by weight, more preferably from 5 to 15% by weight, based on the weight of hydrophilic alumina. If it is less than 1% by weight or more than 30% by weight, image quality tends to degrade. Addition of a layer amount of the silica is also disadvantageous in that fog tends to be produced on long-term use.

The titanium dioxide fine particles which can be used in combination with the hydrophilic alumina are not particularly limited and include, for example, p-25 (a product of Nippon Aerosil Co., Ltd.) and STT 30 D (a product of Titan Kogyo K.K.). The titanium dioxide particles to be used have an average particle size of generally from about 0.005 to 1.000 μm, and preferably from 0.010 to 0.050 μm. The amount of the titanium dioxide to be added preferably ranges from 5 to 100% by weight, more preferably from 10 to 30% by weight, based on the weight of hydrophilic alumina. If it is less than 5% by weight or more than 100% by weight,image quality tends to degrade.

Any of known binder resins may be used for the toner. Examples of usable binder resins include homo- or copolymers of styrenes, e.g., styrene, chlorostyrene, vinylstyrene, etc.; monoolefins, e.g., ethylene, propylene, butylene, isobutylene, etc.; vinyl esters, e.g., vinyl acetate, vinyl propionate, vinyl benzoate, vinyl butyrate, etc.; α-methylene aliphatic monocarboxylic acid esters, e.g., methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, etc.; vinyl ethers, e.g., vinyl methyl ether, vinyl ethyl ether, vinyl butyl ether, etc.; vinyl ketones, e.g., vinyl methyl ketone, vinyl hexyl ketone, vinyl isopropenyl ketone, etc.; and the like. Of these, typically employed binder resins include polystyrene, a styrene/alkyl acrylate copolymer, a styrene/alkyl methacrylate copolymer, a styrene/acrylonitrile copolymer, a styrene/butadiene copolymer, a styrene/maleic anhydride copolymer, polyethylene, polypropylene, polyester, amino-esterified polyester, a styrene/acrylic polyester copolymer, polyurethane, an epoxy resin, a silicone resin, polyamide, modified rosine, paraffin, waxes, etc. Of these, a terminal amino-esterified polyester and a styrene/acrylate copolymer containing less than 50% by weight of styrene are preferred.

Colorants for the toner are conventional, and examples include black colorants, chromatic colorants, and the like. A typical example of the black colorants is carbon black, and examples of the chromatic colorants include copper phthalocyanine type cyan colorants (e.g., C.I. Pigment No. Blue 15-3 and C.I. Pigment No. Blue 15-1), azo type yellow colorants (e.g., C.I. Pigment No. Yellow 97 and C.I. Pigment No. Yellow 12), azo type magenta colorants (e.g., C.I. Pigment No. Red 5 and C.I. Pigment No. Red 48-2), and quinacridone type magenta colorants (e.g., C.I. Pigment No. Red 122). The colorant can be used independently or as a mixture, and the colorant is generally added in an amount (total) of about 5 to 10% by weight based on the weight of toner.

In the cases where the chromatic colorant is incorporated into the toner, the effects of the present invention become remarkable. It is assumed that the chromatic colorant shows its charge control effects attributed to the molecular structure thereof. In particular, such a tendency is pronounced in the case of using copper phthalocyanine pigments.

The toner according to the present invention may further contain in the binder resin other known additives, such as a positively charge control agents, as described, for example, in Japanese Patent Application (OPI) Nos. 158932/79 and 11461/81. In such a case, it should be noted that materials of the binder resin, charge control agent and carrier be chosen so that the toner may be charged positively by friction with the carrier.

The toner in the developer of the present invention generally has an average particle size of not more than about 30 μm, and preferably of from 3 to 20 μm.

The above-described toner is combined with a carrier to serve as two-component system developer. Conventional carriers, such as iron powders, ferrite carriers, magnetic power-dispersed carriers, resin-coated carriers having e.g., a steel core, etc., can be used in the present invention. Preferred are those having magnetic powder dispersed in a resin. The resin and magnetic powder may be conventional ones. Examples of the resin include polystyrene and a styrene/(meth)acrylate copolymer having more than 50% by weight of styrene, e.g., styrene/n-butyl methacrylate/methyl acrylate copolymer (85/15/5 by weight), styrene/n-butyl methacrylate (85/15 by weight etc., and examples of the magnetic powder include EPT 1000 and MTA 740 (both products of Toda Kogyo K.K.). The magnetic powder is preferably used in an amount of from 40 to 80% by weight, more preferably from 70 to 80% by weight, based on the weight of resin. Resins for the resind-coated carriers include fluorine-containing resins (e.g., polyvinylidene fluoride, a polymethyl methacrylate/-polyvinylidene fluoride/styrene terpolymer, a polytetrafluoroethylene-containing resin, etc.) resinous vinylidene chloride copolymers, acrylic resins, silicone resin, etc, as described in U.S. Pat Nos. 4,338,390, 3,795,617, 3,923,503 and 3,798,167, and Japanese Patent Application (OPI) Nos. 2133/79, 60961/80, 113146/81 and 80162/86.

The toner is generally used in an amount of from about 1 to 20% by weight, preferably from 3 to 10% by weight, based on the weight of carrier.

The present invention will now be illustrated in greater detail with reference to the following examples, but it should be understood that the present invention is not deemed to be limited thereto. In these examples, all the parts, percents, and ratios are given by weight unless otherwise indicated.

EXAMPLE 1

Thirty-five parts of a terminal dimethylamino-ethyl-esterified polyester, 1 part of polypropylene wax, 57 parts of a styrene/butyl methacrylate/acrylonitrile copolymer (70/25/5), and 7 parts of copper phthalocyanine were kneaded, ground, and classified to obtain toner particles having an average particle size of 12 μm. A hundred parts of the toner particles were mixed with 1.2 parts of Aluminum Oxide C (produced by Nippon Aerosil Co., Ltd.; average particle size 0.020 μm) and 1.5 parts of tin oxide having an average particle size of 0.2 μm and a specific resistivity of $4.1\times107$ Ω·cm in a Henschel mixer to adhere these external additives onto the toner particles.

Separately, 30 parts of a styrene/n-butyl methacrylate copolymer (65/35), and 70 parts by weight of magnetite "EPT-1000" (produced by Toda Kogyo K.K.) were kneaded, ground, and classified to obtain a carrier having an average particle size of 35 μm.

Ten parts of the toner and 90 parts of the carrier were mixed to prepare an electrophotographic developer. The resulting developer was charged in a copying machine "FX-7790" (manufactured by Fuji Xerox Co., Ltd.), and running test was carried out to obtain 500,000 copies. All the resulting copy images had satisfactory quality in density contrast and were free from fog. Further, the phenomena of toner dropping and toner cloud were found very slight.

COMPARATIVE EXAMPLE 1

A developer was prepared in the same manner as in Example 1, except that the tin oxide fine particles were not used. As a result of running test on FX-7790, a serious toner cloud phenomenon took place after 200,000 copies were obtained.

COMPARATIVE EXAMPLE 2

A developer was prepared in the same manner as in Example 1, except that Aluminum Oxide C was not used. As a result of running test on FX-7790, fog generated on the 150,000th copy.

COMPARATIVE EXAMPLE 3

A developer was prepared in the same manner as in Example 1, except for replacing Aluminum Oxide C with Silica 130 (produced by Nippon Aerosil Co., Ltd.; average particle size 0.016 μm) having been treated with 10% of γ-aminopropyltriethoxysilane. As a result of running test on FX-7790, fog generated on the 100,000th copy.

EXAMPLE 2

A developer was prepared in the same manner as in Example 1, except for further using 1 part of cetylpyridinium chloride (charge control agent) in the preparation of toner particles. As a result of running test on FX-7790 to obtain 500,000 copies, the quality of the resulting copy images was satisfactory as well as in Example 1.

EXAMPLE 3

A developer was prepared in the same manner as in Example 1, except for changing the amount of Aluminum Oxide C to 1.8 parts and replacing the tin oxide with 0.4 part of hydrophobic silica "R972" (produced by Nippon Aerosil Co., Ltd.; average particle size 0.016 μm). When the resulting developer was subjected to running test on FX-7790 to obtain 300,000 copies, all the copy images obtained were free from fog and had high density contrast. Further, the phenomena of toner dropping and toner cloud were very slight.

COMPARATIVE EXAMPLE 4

A developer was prepared in the same manner as in Example 3, except that the hydrophobic silica R-972 was not used. As a result of running test on FX-7790, toner cloud became serious on the 100,000th copy.

COMPARATIVE EXAMPLE 5

A developer was prepared in the same manner as in Example 3, except for replacing Aluminum Oxide C with Silica 130 having been treated with 10% of γ-aminopropyltriethoxysilane. As a result of running test on FX-7790, fog generated on the 50,000th copy.

EXAMPLE 4

A developer was prepared in the same manner as in Example 3, except for further using 1 part of cetylpyridinium chloride in the preparation of toner particles. As a result of running test on FX-7790 to obtain 300,000 copies, the copy images had satisfactory quality as in Example 3.

EXAMPLE 5

A developer was prepared in the same manner as in Example 1, except for replacing the tin oxide with 0.8 part of titanium dioxide "P-25" (produced by Nippon Aerosil Co., Ltd.; average particle size 0.021 μm). As a result of running test on FX-7790 to obtain 500,000 copies, the resulting copied images had satisfactory quality and density contrast and were free from fog. Further, the phenomena of toner dropping and toner cloud were very slight.

COMPARATIVE EXAMPLE 6

A developer was prepared in the same manner as in Example 5, except for excluding Aluminum Oxide C. As a result of running test on FX-7790, fog generated on the 200,000th copy.

COMPARATIVE EXAMPLE 7

A developer was prepared in the same manner as in Example 5, except for replacing Aluminum Oxide C with Silica 130 having been treated with 10% of γ-aminopropyltriethoxysilane. As a result of running test on FX-7790, fog generated on the 100,000th copy.

EXAMPLE 6

A developer was prepared in the same manner as in Example 5, except for further using 1 part of cetylpyridinium chloride for the preparation of the toner particles. As a result of running test on FX-7790 to obtain 500,000 copies, the resulting copy images had satisfactory quality as in Example 5.

As described above, the electrophotographic developer according to the present invention containing hydrophilic alumina fine particles in combination with fine particles of one of tin oxide, hydrophobic silica, and titanium dioxide is a positively chargeable developer which hardly cause toner cloud or toner dropping during development processing and can form high density images for an extended period of time without suffering extreme deterioration in charging properties or fog formation even when repeatedly used for making a large number of copies.

While the invention has been described in detail and with reference to specific embodiments thereof, it will be apparent to one skilled in the art that various changes and modifications can be made therein without departing from the spirit and scope thereof.

What is claimed is:

1. An electrophotographic developer comprising a carrier, toner particles positively chargeable by friction with the carrier, fine particles of hydrophilic alumina, and fine particles of one of tin oxide, hydrophobic silica and titanium dioxide.

2. An electrophotographic developer as claimed in claim 1, wherein said toner particles contain a chromatic colorant.

3. An electrophotographic developer as claimed in claim 2, wherein said chromatic colorant is a copper phthalocyanine pigment.

4. An electrophotographic developer as claimed in claim 1, wherein the hydrophilic alumina fine particles are present in an amount of from about 0.1 to 3.0% by weight based on the weight of toner particles.

5. An electrophotographic developer as claimed in claim 1, wherein the tin oxide fine particles are present in an amount of from 0.5 to 3 times the weight of hydrophilic alumina fine particles.

6. An electrophotographic developer as claimed in claim 1, wherein the hydrophobic silica fine particles are present in an amount of from 1 to 30% by weight based on the weight of hydrophilic alumina fine particles.

7. An electrophotographic developer as claimed in claim 1, wherein the titanium dioxide fine particles are present in an amount of from 5 to 100% by weight based on the weight of hydrophilic alumina fine particles.

8. An electrophotographic developer as claimed in claim 1, wherein said carrier comprises magnetic powders dispersed in a resin.

9. An electrophotographic developer as claimed in claim 1, wherein said hydrophilic alumina fine particles have an average particle size of from 0.010 to 0.030 $\mu$m.

10. An electrographic developer as claimed in claim 1, wherein said tin oxide fine particles have a specific resistivity of from $10^5$ to $10^8$ $\Omega$·cm.

11. An electrophotographic developer as claimed in claim 1, wherein said hydrophobic silica fine particles have an average particle size of from 0.010 to 0.030 $\mu$m.

12. An electrophotographic developer as claimed in claim 1, wherein said titanium dioxide fine particles have an average particle size of from 0.010 to 0.050 $\mu$m.

13. An electrophotographic developer as claimed in claim 1, wherein said toner particles consist essentially of a binder resin, a chromatic colorant and a charge control agent.

* * * * *